US010369605B2

(12) United States Patent
Takatsuki et al.

(10) Patent No.: US 10,369,605 B2
(45) Date of Patent: Aug. 6, 2019

(54) ROLLING MILL ROLL

(71) Applicant: MITSUBISHI MATERIALS CORPORATION, Tokyo (JP)

(72) Inventors: Mitsuhiro Takatsuki, Anpachi-gun (JP); Hiroyuki Tanaka, Tokyo (JP); Hiromasa Arimura, Anpachi-gun (JP); Tadamasa Miyagawa, Anpachi-gun (JP); Tsukasa Umeta, Anpachi-gun (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

(21) Appl. No.: 15/560,235

(22) PCT Filed: Mar. 25, 2016

(86) PCT No.: PCT/JP2016/059558
§ 371 (c)(1),
(2) Date: Sep. 21, 2017

(87) PCT Pub. No.: WO2016/158722
PCT Pub. Date: Oct. 6, 2016

(65) Prior Publication Data

US 2018/0071802 A1 Mar. 15, 2018

(30) Foreign Application Priority Data

Mar. 27, 2015 (JP) ..... 2015-066761

(51) Int. Cl.
*B21B 27/02* (2006.01)
*B21B 27/03* (2006.01)

(52) U.S. Cl.
CPC ..... *B21B 27/024* (2013.01); *B21B 27/035* (2013.01)

(58) Field of Classification Search
CPC ..... B21D 27/024; B21D 27/04
See application file for complete search history.

(56) References Cited

U.S. PATENT DOCUMENTS 4,622,730 A * 11/1986 Steinbock ..... B21B 27/035 403/320
5,735,788 A 4/1998 Yasutake et al.

FOREIGN PATENT DOCUMENTS

GB 2156935 A 10/1985
JP 61-010107 A 1/1986
(Continued)

OTHER PUBLICATIONS

International Search Report dated May 17, 2016, issued for PCT/JP2016/059558 and English translation thereof.

*Primary Examiner* — Teresa M Ekiert
(74) *Attorney, Agent, or Firm* — Locke Lord LLP

(57) ABSTRACT

A rolling mill roll according to the present invention includes: a shaft member which rotates around an axial line; a rolling ring which is fitted to an outer circumferential surface of the shaft member; a support portion which is provided on the outer circumferential surface of the shaft member; an interposed ring which is fitted to the outer circumferential surface of the shaft member and is provided on the other side of the rolling ring in the axial line direction; a pressing nut which is screwed onto the outer circumferential surface of the shaft member and is disposed to be adjacent to the other side of the interposed ring; a screw hole which is formed to penetrate the pressing nut in the axial line direction; and a screw shaft which is screwed into the screw hole and which is capable of pressing the interposed ring toward the one side in the axial line direction.

11 Claims, 2 Drawing Sheets

(56) References Cited

FOREIGN PATENT DOCUMENTS

| | | | |
|---|---|---|---|
| JP | 09-029314 | A | 2/1997 |
| JP | 2537658 | Y2 | 6/1997 |
| JP | 3198877 | B2 | 8/2001 |

* cited by examiner

ROLLING MILL ROLL

TECHNICAL FIELD

The present invention relates to a rolling mill roll which rolls various metal materials such as wire rods or steel bars, for example.

Priority is claimed on Japanese Patent Application No. 2015-066761, filed on Mar. 27, 2015, the content of which is incorporated herein by reference.

BACKGROUND ART

In the related art, for example, as described in the following PTL 1, a rolling mill roll which rolls various metal materials such as wire rods or steel bars is known.

The rolling mill roll includes a shaft member which rotates around an axial line, a rolling ring which is fitted to an outer circumferential surface of the shaft member and is formed of cemented carbide or the like, a flange which protrudes from an end portion of the outer circumferential surface of the shaft member on one side in an axial line direction and restrains a movement of the rolling ring toward one side in the axial line direction, a pressing nut which is screwed onto an end portion on the other side of the outer circumferential surface of the shaft member in the axial line direction, a plurality of screw holes which are formed to penetrate the pressing nut in the axial line direction, and screw shafts which are screwed into the screw holes and press the rolling ring toward the one side in the axial line direction via spacers disposed adjacent to the other side of the rolling ring in the axial line direction.

In the rolling mill roll, the spacer is pushed toward the one side in the axial line direction by a head portion of the screw shaft by adjusting a screwing position (screwing amount) of the screw shaft (headed bolt) with respect to the screw hole. Accordingly, the rolling ring is pressed to the one side in the axial line direction by the screw shaft via the spacer and is held with the flange so as to be fixed to the shaft member.

In addition, cooling water is supplied to the vicinity of the rolling ring during the rolling.

CITATION LIST

Patent Literature

[PTL 1] Japanese Patent No. 3198877

SUMMARY OF INVENTION

Technical Problem

However, in the rolling mill roll of the related art, since the cooling water supplied to cool the rolling ring enters a portion between the rolling ring and the shaft member through a portion (that is, a gap in which the head portion of the screw shaft is disposed) between the pressing nut and the spacer, there is a concern that the shaft member may be corroded.

Accordingly, if corrosion occurs in the shaft member, for example, the rolling ring may slip or wear of the shaft member may be accelerated, which influences accuracy of rolling or the tool life.

The present invention is made in consideration of the above-described circumstances, and an object thereof is to provide a rolling mill roll capable of accurately and stably performing rolling over a long period of time and extending the tool life by preventing corrosion of the shaft member generated due to entering of cooling water.

Solution to Problem (1) According to an aspect of the present invention, a rolling mill roll is provided, including: a shaft member which rotates around an axial line; a rolling ring which is fitted to an outer circumferential surface of the shaft member; a support portion which is provided on the outer circumferential surface of the shaft member and restrains a movement of the rolling ring toward one side in an axial line direction, with respect to the shaft member; an interposed ring which is fitted to the outer circumferential surface of the shaft member and is provided on the other side of the rolling ring in the axial line direction; a pressing nut which is screwed onto the outer circumferential surface of the shaft member and is disposed to be adjacent to the other side of the interposed ring in the axial line direction; a screw hole which is formed to penetrate the pressing nut in the axial line direction; and a screw shaft which is screwed into the screw hole and which is capable of pressing the interposed ring toward the one side in the axial line direction, in which at least a portion between the pressing nut and the interposed ring is sealed so as to restrain passage of a liquid from an outer circumference of the rolling mill roll to an inner circumference side of the rolling mill roll.

In this rolling mill roll, by adjusting a screwing position (screwing amount) of the screw shaft with respect to the screw hole of the pressing nut, the interposed ring is pushed toward one side in the axial line direction by the screw shaft. Accordingly, the rolling ring is pressed to the one side in the axial line direction by the screw shaft via the interposed ring. Since the movement of the rolling ring toward the one side in the axial line direction is restrained by the support portion, the rolling ring is held from both sides in the axial line direction by the interposed ring and the support portion. Accordingly, the interposed ring is fixed to the shaft member.

Since the present invention uses the above-described configuration, for example, a complicated large-scale facility such as using a hydraulic adjustment mechanism for fixing the rolling ring is not required, and it is possible to simplify the facility.

In addition, since the screw shaft screwed into the screw hole of the pressing nut presses the interposed ring, a gap is formed between the pressing nut and the interposed ring according to the screwing amount of the screw shaft.

However, in the rolling mill roll, at least a portion between the pressing nut and the interposed ring adopts the configuration which seals the portion so as to restrain passage of a liquid from the outer circumference of the rolling mill roll to the inner circumference side thereof. That is, since at least a portion between the pressing nut and the interposed ring is sealed, it is possible to restrain a liquid from entering the inside of the rolling mill roll from the outside thereof through a portion between the pressing nut and the interposed ring. Accordingly, it is possible to prevent cooling water supplied during rolling from entering the portion between the rolling ring and the shaft member through the portion between the pressing nut and the interposed ring.

In this way, since it is possible to prevent entering of the cooling water, it is possible to prevent corrosion of the shaft member, and for example, it is possible to effectively prevent slip of the rolling ring or wear of the shaft member.

According to the present invention, it is possible to accurately and safely perform rolling over a long period of time and extend the tool life by preventing corrosion of the shaft member generated due to entering of cooling water.

(2) Preferably, the pressing nut and the interposed ring are positioned to face each other in a radial direction at a predetermined position further outside in the radial direction than a portion of the interposed ring which is pressed by the screw shaft, and an annular seal member extending around the axial line is provided at the predetermined position.

In this case, the pressing nut and the interposed ring are positioned to face each other in the radial direction at the predetermined position further outside in the radial direction than the portion (a portion of the interposed ring on which the screw shaft abuts) of the interposed ring which is pressed by the screw shaft. In addition, the seal member is disposed at the predetermined position, and the portion between the pressing nut and the interposed ring is sealed by the seal member to restrain passage of a liquid.

Accordingly, even in a case where a relative position between the pressing nut and the interposed ring in the axial line direction is changed (even when the pressing nut and the interposed ring slidably move in the axial line direction) by adjusting the screwing amount of the screw shaft with respect to the screw hole of the pressing nut during the fixing of the rolling ring, since the relative position in the radial direction between the pressing nut and the interposed ring is not changed at the predetermined position, it is possible to favorably maintain the seal state realized by the seal member at the predetermined position.

Therefore, the above-described effects of the present invention are more stably achieved.

In addition, the predetermined position at which the seal member is disposed is positioned further outside in the radial direction than the portion of the interposed ring pressed by the screw shaft. Accordingly, it is possible to prevent cooling water from entering "the portion where the screw shaft presses the interposed ring" which tends to require an adjustment space, by the seal member. Therefore, it is possible to prevent accumulation of water in the adjustment space.

Accordingly, not only corrosion of the shaft member but also corrosion of the pressing nut, the screw shaft, and the interposed ring can be prevented.

(3) Preferably, annular seal members extending around the axial line are provided on both end surfaces of the rolling ring in the axial line direction.

(4) Preferably, an annular seal member extending around the axial line is provided on an end surface on one side of the interposed ring in the axial line direction.

As described above, for example, in the case where the seal member such as an O ring extending around the axial line is provided on each of both end surfaces of the rolling ring in the axial line direction or on the end surface on one side of the interposed ring in the axial line direction, it is possible to prevent cooling water from entering the portion between the rolling ring and the shaft member or the interposed ring and the shaft member through the end surface.

Accordingly, it is possible to more reliably prevent the corrosion of the shaft member.

In addition, the rolling ring and the interposed ring may be disposed to be adjacent to each other (to come into direct-contact with each other) in the axial line direction and a spacer may be disposed between the rolling ring and the interposed ring. In any configuration, it is possible to prevent cooling water entering the inside of the rolling mill roll.

(5) Preferably, a surface-hardening treatment is applied to at least the portion pressed by the screw shaft in the end surface on the other side of the interposed ring in the axial line direction.

In this case, since a surface-hardening treatment is applied to at least the portion pressed by the screw shaft in the end surface on the other side of the interposed ring in the axial line direction, it is possible to increase hardness of the portion pressed by the screw shaft.

Accordingly, when the screw shaft is screwed into the screw hole of the pressing nut and the rolling ring is pressed in the axial line direction via the interposed ring to be fixed to the shaft member, it is possible to prevent the end surface of the interposed ring from being deformed (recessed) by a pressing force of the screw shaft.

Accordingly, it is possible to reliably fix the rolling ring to the shaft member. In addition, even when the end surface of the interposed ring is repeatedly pressed by the screw shaft, the above-described effects can be stably achieved.

In addition, as the surface-hardening treatment, for example, high-frequency quenching or the like can be mentioned.

Specifically, for example, preferably, hardness of the portion of the end surface of the interposed ring which is pressed by the screw shaft has a Rockwell hardness of 45 HRC or more. Accordingly, it is possible to favorably prevent the end surface of the interposed ring from being deformed.

(6) Preferably, the support portion is a support nut which is screwed onto the outer circumferential surface of the shaft member and is disposed on one side of the rolling ring in the axial line direction.

In this case, when the rolling ring is fixed to the shaft member, it is possible to prevent deformation of the support portion (support nut).

Specifically, when the rolling ring is fixed, if the screw shaft is tightened to the screw hole of the pressing nut, for example, a large axial load (lateral pressure) having approximately 500 to 600 tons is applied to the rolling mill roll in the axial line direction, stress is easily concentrated at the support portion receiving the lateral pressure.

With respect to this, in the present invention, the support nut which is screwed onto the outer circumferential surface of the shaft member is adopted as the support portion. Accordingly, even in a case where a large lateral pressure is applied to the support nut, since it is possible to disperse stress over the entire screwing region between the shaft member and the support nut, it is possible to prevent deformation or the like of the support nut.

Therefore, it is possible to stably fix the rolling ring and, for example, prevent slip or the like of the rolling ring.

Advantageous Effects of Invention

According to the rolling mill roll of the present invention, it is possible to accurately and stably perform rolling over a long period of time and extend the tool life by preventing corrosion of the shaft member generated due to entering of cooling water.

DESCRIPTION OF EMBODIMENTS

Hereinafter, a rolling mill roll 1 according to an embodiment of the present invention will be described with reference to the drawings.

(Schematic Configuration of Rolling Mill Roll)

Figure 1:
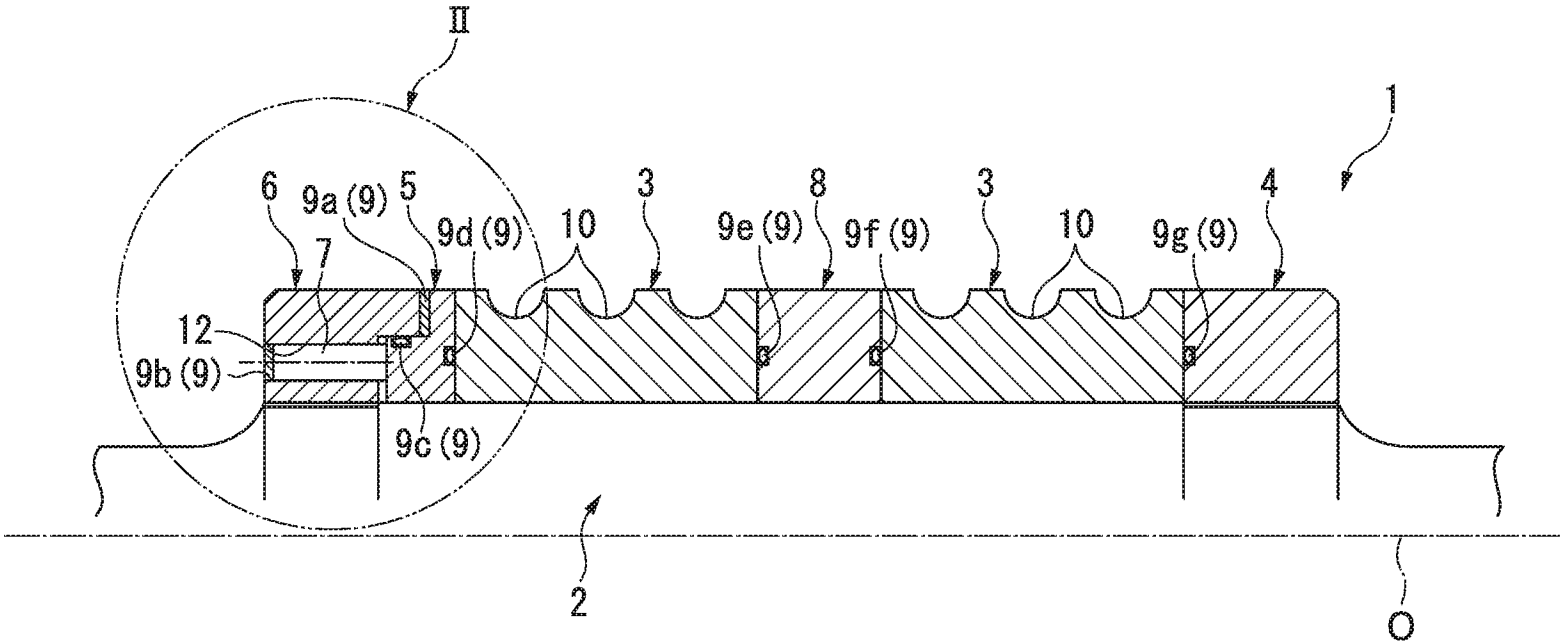
FIG. 1 is a longitudinal sectional view showing a main portion of a rolling mill roll according to an embodiment of the present invention.

As shown in FIG. 1, for example, a rolling mill roll 1 of the present embodiment performs rolling on various metal materials such as wire rods or steel bars. The rolling mill roll 1 is rotationally driven around an axial line O by transmitting rotation torque of a rolling machine to a shaft member 2.

In addition, during the rolling, cooling water is supplied to the vicinities of rolling rings 3 of the rolling mill roll 1 from the outside.

As shown in FIG. 1, the rolling mill roll 1 includes the shaft member 2, the rolling rings 3, a support nut (support portion) 4, an interposed ring 5, a pressing nut 6, a screw shaft 7, a spacer 8, and a seal member 9.

In the example of the present embodiment, the outer diameters of the rolling rings 3, the support nut 4, the interposed ring 5, the pressing nut 6, and the spacer 8 are approximately the same as each other (approximately the same diameter).

However, the present invention is not limited to this, and the outer diameters of the rolling rings 3, the support nut 4, the interposed ring 5, the pressing nut 6, and the spacer 8 may be different from each other.

For example, the shaft member 2, the support nut 4, the interposed ring 5, and the pressing nut 6 are formed of an SCM material. For example, the rolling rings 3 are formed of cemented carbide such as WC. For example, the spacer 8 is formed of an S45C material.

In addition, types (materials) of materials configuring the shaft member 2, the rolling rings 3, the support nut 4, the interposed ring 5, the pressing nut 6, and the spacer 8 are not limited to the above-described examples.

(Definition of Direction Used in the Specification)

In the present specification, a direction in which the axial line O of the shaft member 2 extends is referred to as an axial line O direction. In addition, in FIG. 1, a direction from the pressing nut 6 toward the support nut 4 side along the axial line O direction is referred to as one side in the axial line O direction (or, simply referred to as one side), and a direction from the support nut 4 toward the pressing nut 6 side is referred to as the other side in the axial line O direction (or, simply referred to as the other side).

In addition, a direction orthogonal to the axial line O is referred to as a radial direction, a direction close to the axial line O in the radial direction is referred to as an inside in the radial direction, and a direction separated from the axial line O is referred to an outside in the radial direction. In addition, a direction around the axial line O is referred to as a circumferential direction.

(Shaft Member)

The shaft member 2 is formed in a multistage cylindrical shape. Both end portions (or only one of the two end portions) of the shaft member are rotatably supported by the rolling machine (not shown). During rolling, the shaft member 2 rotates in a predetermined rotation direction in the circumferential direction around the axial line O.

In FIG. 1, a diameter of each of both end portions of the shaft member 2 in the axial line O direction is smaller than a portion (intermediate portion) positioned between both end portions. In addition, the rolling rings 3, the support nut 4, the interposed ring 5, the pressing nut 6, and the spacer 8 are provided on the intermediate portion of the shaft member 2.

In addition, in the present specification, an "outer circumferential surface of the shaft member 2" indicates the outer circumferential surface of the intermediate portion positioned between both end portions of the shaft member 2.

In the example shown in FIG. 1, the outer circumferential surface of the shaft member 2 has an approximately constant outer diameter. Accordingly, the inner diameters of the rolling rings 3, the support nut 4, the interposed ring 5, the pressing nut 6, and the spacer 8 disposed on the outer circumferential surface of the shaft member 2 are approximately the same (have the same inner diameter) as each other.

However, the present invention is not limited to this, and for example, in the outer circumferential surface of the shaft member 2, diameters of portions at which at least the rolling rings 3 and the spacer 8 are disposed may be larger than a diameter of a portion except for the portions at which the rolling rings 3 and the spacer 8 are positioned. In other words, in the outer circumferential surface of the shaft member 2, a diameter of a portion at which at least one of the pressing nut 6, the interposed ring 5, and the support nut 4 is disposed may be smaller than the diameters of the portions at which the rolling rings 3 and the spacer 8 are disposed.

In addition, in this case, the outer diameter of the portion having a large diameter in the shaft member 2 is smaller than the outer diameter of the member (the pressing nut 6, the interposed ring 5, and the support nut 4) mounted on the portion having a small diameter.

In the outer circumferential surface of the shaft member 2, a male screw portion to which male screw processing is applied is formed on each of an end portion (a right end portion in FIG. 1) on one side in the axial line O direction and an end portion (a left end portion in FIG. 1) on the other side.

In addition, in the outer circumferential surface of the shaft member 2, the portion between both end portions (between the male screw portions) in the axial line O direction is a simple cylindrical outer circumferential surface.

(Rolling Ring)

The rolling ring 3 is formed in a cylindrical shape and is fitted to the outer circumferential surface of the shaft member 2. In the present embodiment, a plurality of (two in the example of FIG. 1) rolling rings 3 are provided on the outer circumferential surface of the shaft member 2 at intervals therebetween in the axial line O direction.

However, the present invention is not limited to this, and only one rolling ring 3 may be provided on the outer circumferential surface of the shaft member 2.

Forming grooves (calibers) 10 are formed on each of the outer circumferential surfaces of the rolling rings 3. The forming groove 10 is recessed toward the inside in the radial direction from the outer circumferential surface of the rolling ring 3 and is annularly formed to extend in the circumferential direction.

During the rolling, the forming grooves 10 of the rolling rings 3 come into direct contact with a work piece (a material to be rolled) formed of a metal material to form the work piece. The shapes of the forming grooves 10 in a longitudinal sectional view (in a sectional view in the axial line O direction shown in FIG. 1) are set according to the work piece.

In the example shown in FIG. 1, a plurality of forming grooves 10 are disposed on the outer circumferential surface of each of the rolling rings 3 at intervals in the axial line O direction.

However, the present invention is not limited to this and only one forming groove 10 may be provided on the outer circumferential surface of the rolling ring 3.

(Support Nut)

The support nut (support portion) 4 is provided on the outer circumferential surface of the shaft member 2 and restrains the movements of the rolling rings 3 toward the one side in the axial line O direction, with respect to the shaft member 2. That is, the support nut 4 restrains the movements of the rolling rings 3 toward the one side in the axial line O direction, with respect to the shaft member 2.

In the present embodiment, as the support portion having this function, the support nut 4 which is screwed onto the outer circumferential surface of the shaft member 2 is used.

In addition, preferably, the length (screwing region) of the support nut 4 in the axial line O direction is 30 mm or more.

Specifically, the support nut 4 is disposed on the one side of the rolling ring 3 in the axial line O direction of the outer circumferential surface of the shaft member 2 and is screwed onto the male screw portion positioned on the end portion on the one side of the outer circumferential surface of the shaft member 2.

In the shown example, the end surface (side surface facing the one side) on the one side of the rolling ring 3 in the axial line O direction comes into direct contact with the end surface (side surface facing the other side) on the other side of the support nut 4 in the axial line O direction.

However, the present invention is not limited to this, and the spacer 8 may be interposed between the support nut 4 and the rolling ring 3.

(Spacer)

The spacer 8 is interposed between the rolling rings 3 adjacent to each other in the axial line O direction on the outer circumferential surface of the shaft member 2. In addition, in the example of the present embodiment, only one spacer 8 is provided on the outer circumferential surface of the shaft member 2. However, a plurality of spacers 8 may be provided.

(Interposed Ring)

Figure 2:
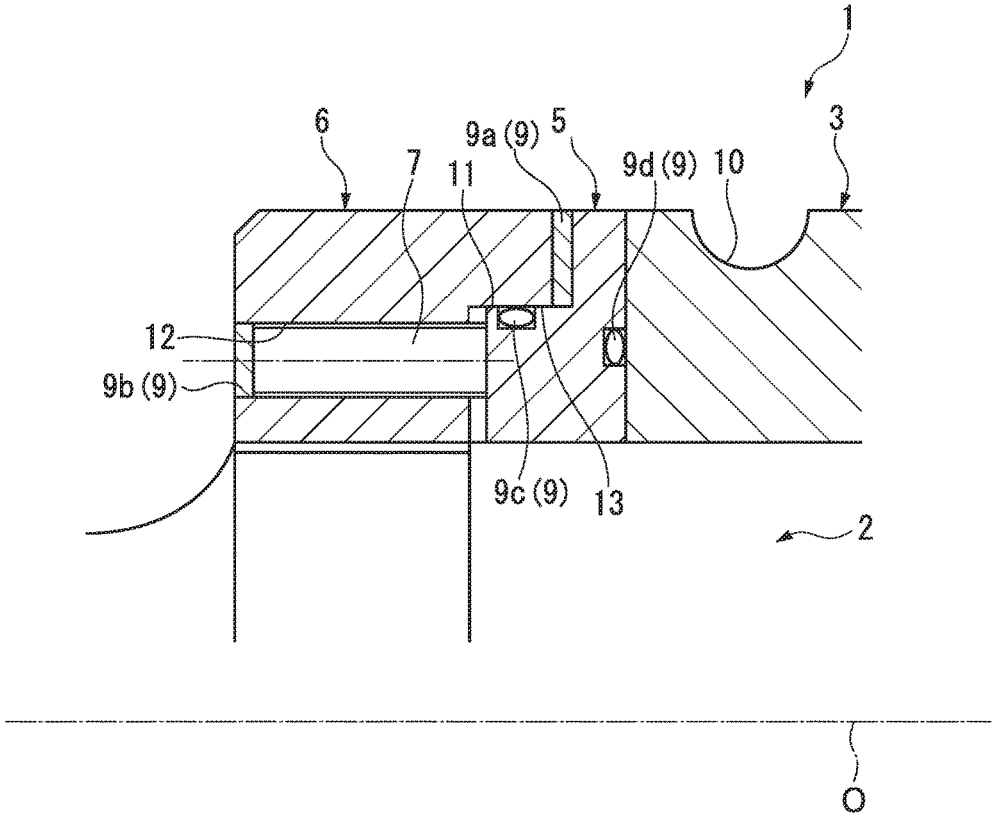
FIG. 2 is an enlarged view of the portion indicated by arrow II of FIG. 1.

As shown in FIGS. 1 and 2, the interposed ring 5 is fitted to the outer circumferential surface of the shaft member 2 and is provided on the other side of the rolling ring 3 in the axial line O direction.

In the example of the present embodiment, the end surface (the side surface facing the other side, that is, the surface facing the left side in FIG. 2) on the other side of the rolling ring 3 in the axial line O direction comes into direct contact with the end surface (the side surface facing the one side, that is, the surface facing the right side in FIG. 2) on the one side of the interposed ring 5 in the axial line O direction.

However, the present invention is not limited to this and the spacer 8 may be interposed between the interposed ring 5 and the rolling ring 3.

As shown in FIG. 2, in the interposed ring 5, a fitting shaft portion 11 having an outer diameter which is smaller than an outer diameter of a portion except for a portion of the interposed ring 5 positioned on the other side in the axial line O direction is formed on the other side of the interposed ring 5 in the axial line O direction. In the shown example, the length of the fitting shaft portion 11 in the axial line O direction is set to approximately half of the entire length of the interposed ring 5 in the axial line O direction.

In addition, the fitting shaft portion 11 may be formed on the end portion on at least the other side of the interposed ring 5 in the axial line O direction. In addition, the fitting shaft portion 11 may be formed over the entire length of the interposed ring 5.

In the end surface on the other side of the fitting shaft portion 11 of the interposed ring 5 in the axial line O direction, a surface-hardening treatment is applied to a portion (abutting portion) which is pressed by at least the screw shaft 7.

In addition, for example, as the surface-hardening treatment, high-frequency quenching or the like can be mentioned. Specifically, for example, preferably, hardness of the portion of the end surface of the interposed ring 5 which is pressed by the screw shaft 7 has a Rockwell hardness of 45 HRC or more.

(Pressing Nut)

The pressing nut 6 is screwed onto the outer circumferential surface of the shaft member 2 and is disposed to be adjacent to the other side of the interposed ring 5 in the axial line O direction. The pressing nut 6 is screwed onto the male screw portion which is positioned on the end portion on the other side of the outer circumferential surface of the shaft member 2.

Preferably, the length (screwing region) of the pressing nut 6 in the axial line O direction is 30 mm or more. In addition, in the example of the present embodiment, the length of the pressing nut 6 in the axial line O direction is shorter than the length of the support nut 4 in the axial line O direction.

A screw hole 12 penetrating the pressing nut 6 in the axial line O direction is formed in the pressing nut 6.

The screw hole 12 is not a through-hole (a female screw hole to have a function of a nut) positioned on the axial line O and is a through-hole which is formed at a position of the pressing nut 6 separated from the axial line O toward the outside in the radial direction. That is, the screw hole 12 is positioned between the inner circumference surface of the pressing nut 6 and the outer circumferential surface thereof.

A plurality of screw holes 12 are formed in the pressing nut 6 at intervals therebetween in the circumferential direction. In the present embodiment, the screw holes 12 are disposed at equal intervals therebetween in the circumferential direction.

A fitting hole portion 13 is formed in the portion of the pressing nut 6 positioned on the one side in the axial line O direction, and the inner diameter of the fitting hole portion 13 is larger than the inner diameter of a portion except for the portion of the pressing nut 6 positioned on the one side in the axial line O direction.

The fitting hole portion 13 is open toward one side in the axial line O direction. The inner circumference surface of the fitting hole portion 13 is positioned further outside in the radial direction than the screw hole 12.

The fitting shaft portion 11 of the interposed ring 5 is fitted to the inside of the fitting hole portion 13 in the radial direction. That is, the pressing nut 6 and the interposed ring 5 are disposed to face each other in the radial direction at the portion in which the fitting hole portion 13 and the fitting shaft portion 11 are fitted to each other.

In addition, in the present specification, the portion in which the inner circumference surface of the fitting hole portion 13 and the outer circumferential surface of the fitting shaft portion 11 are fitted to each other may be referred to as a "predetermined position".

A slight gap is provided between a bottom surface (a surface inside the fitting hole portion 13 facing the one side in the axial line O direction) of the fitting hole portion 13 and an end surface (a surface facing the other side) on the other side of the fitting shaft portion 11 in the axial line O direction.

The gap is defined by the screw shaft 7 described later which is screwed into the screw hole 12 and protrudes from the bottom surface of the fitting hole portion 13 toward the one side in the axial line O direction abutting on the end surface on the other side of the fitting shaft portion 11 in the axial line O direction.

A slight gap is also provided between an end surface (a surface of the pressing nut 6 positioned to be closest to the one side in the axial line O direction) of the pressing nut 6 which is positioned further outside in the radial direction than the fitting hole portion 13 and faces the one side in the axial line O direction and an end surface (a surface positioned to be closest to the other side in the axial line O direction in the portions except for the fitting shaft portion 11 of the interposed ring 5) of the interposed ring 5 which is positioned further outside in the radial direction than the fitting shaft portion 11 and faces the other side in the axial line O direction.

The gap is filled with a seal member 9*a* (9) such as a silicon caulking agent.

In addition, a case where the fitting shaft portion 11 is formed over the entire length of the interposed ring 5 in the axial line O direction, an end surface of the pressing nut 6 which is positioned further outside in the radial direction than the fitting hole portion 13 and faces the one side in the axial line O direction is disposed to face an end surface of the rolling ring 3 facing the other side in the axial line O direction, with a slight gap.

Also in this case, this gap is filled with a seal member such as a silicon caulking agent.

(Screw Shaft)

The screw shaft 7 is screwed into the screw hole 12 of the pressing nut 6 and which is capable of pressing the interposed ring 5 toward the one side in the axial line O direction. In the example of the present embodiment, as the screw shaft 7, a hexagon socket set screw having a constant outer diameter over the entire length of the screw shaft 7 is used.

However, the present invention is not limited to this, for example, the screw shaft 7 may be a head bolt in which the head portion protrudes from the end surface on the other side of the pressing nut 6 in the axial line O direction and a screw portion provided to be continuous with the head portion is screwed into the screw hole 12 and protrudes from the end portion on the one side of the screw hole 12 in the axial line O direction.

In the example of the present embodiment, in both end portions of the screw shaft 7 in the axial line O direction, the end portion on the one side in the axial line O direction protrudes from the screw hole 12 toward the one side and abuts on the end surface of the fitting shaft portion 11 of the interposed ring 5 facing the other side in the axial line O direction.

The end portion on the other side of the screw shaft 7 in the axial line O direction is disposed inside the screw hole 12. In addition, in the screw hole 12, a gap which is positioned to be closer to the other side in the axial line O direction than the screw shaft 7 is filled with a seal member 9*b* (9) such as a silicon caulking agent.

In addition, preferably, a position in the radial direction at which the screw shaft 7 abuts on the interposed ring 5 to press the interposed ring 5 is set to correspond to a center portion (a center portion in which distances from the outer peripheral edge part and the inner circumference edge part of the rolling ring 3 are approximately the same as each other) of the rolling ring 3 in the radial direction or is set to correspond to the inner circumference edge part of the rolling ring 3.

The above-described "predetermined position", that is, the portion in which the inner circumference surface of the fitting hole portion 13 and the outer circumferential surface of the fitting shaft portion 11 are fitted to each other is positioned further outside in the radial direction than the portion of the interposed ring 5 pressed by the screw shaft 7.

(Seal Member)

As shown in FIGS. 1 and 2, the seal member 9 prevents cooling water supplied from the outside of the rolling mill roll 1 from entering the inside of the rolling mill roll 1, and for example, is formed to be elastically deformable.

However, the seal member 9 may not be elastically deformable as long as it has a function which can prevent the entering of the cooling water.

In the present embodiment, as the seal member 9, in addition to the above-described seal members 9*a* and 9*b* such as silicon caulking agents, a plurality of seal members 9*c* to 9*g* configured of O rings are provided. When the seal members 9*c* to 9*g* are disposed in the rolling mill roll 1, all the seal members 9*c* to 9*g* are formed in annular shapes extending around the axial line O.

Among the plurality of seal members 9*c* to 9*g*, the seal member 9*c* (9) is provided at the "predetermined position" at which the pressing nut 6 and the interposed ring 5 face to each other in the radial direction.

Specifically, the seal member 9*c* is accommodated in an annular groove which is formed in any one of the inner circumference surface of the fitting hole portion 13 and the outer circumferential surface of the fitting shaft portion 11.

In this case, in the predetermined position, the seal member 9*c* is accommodated in the annular groove to come into close contact with three inner walls (that is, a pair of side walls facing each other in the axial line O direction and a bottom wall extending in the axial line O direction) of the annular groove and slightly protrude from an opening portion of the annular groove toward the outside of the annular groove. In addition, the portion of the seal member 9*c* protruding toward the outside of the annular groove comes into close contact with the peripheral surface portion facing the annular groove.

In the shown example, the seal member 9*c* is accommodated in an annular groove formed on the outer circumferential surface of the fitting shaft portion 11. In addition, a portion of the seal member 9*c* slightly protrudes from the annular groove toward the outside in the radial direction (toward the outside of the annular groove) and comes into close contact with the inner circumference surface (the peripheral surface portion facing the annular groove) of the fitting hole portion 13.

In addition, a portion between the pressing nut 6 and the interposed ring 5 is sealed (hermetically sealed, tightly sealed) to restrain a liquid from passing through the inner circumference side from the outer circumference of the rolling mill roll 1 by the seal member 9*c* and the above-described seal member 9*a*.

Specifically, at least a portion (two locations in the present embodiment) between the pressing nut 6 and the interposed ring 5 is sealed to restrain a liquid (cooling water) from passing through the inside of the rolling mill roll 1 from the outside thereof by the seal members 9*a* and 9*c*.

In addition, a plurality of seal members 9*c* may be provided at intervals therebetween or to be adjacent to each other in the axial line O direction.

The seal member 9*d* (9) is provided on the end surface on the one side of the interposed ring 5 in the axial line O direction. In addition, in other words, the seal member 9*d* (9) is provided on the end surface on the other side of the rolling ring 3 in the axial line O direction.

That is, the seal member 9*d* is accommodated in an annular groove which is formed in any one of the end surface on the one side of the interposed ring 5 in the axial line O direction and the end surface of the other side of the rolling ring 3 adjacent to the one side of the interposed ring 5 in the axial line O direction.

In this case, the seal member 9*d* is accommodated in the annular groove to come into close contact with three inner walls (that is, a pair of side walls facing each other in the radial direction and a bottom wall extending in the radial direction) of the annular groove and slightly protrudes from an opening portion of the annular groove toward the outside of the annular groove. In addition, the portion of the seal member 9*d* protruding toward the outside of the annular groove comes into close contact with the end surface portion facing the annular groove.

In the shown example, the seal member 9*d* is accommodated in the annular groove formed on the end surface on the one side of the interposed ring 5 in the axial line O direction. In addition, a portion of the seal member 9*d* slightly protrudes from the annular groove toward the one side in the axial line O direction (toward the outside of the annular groove) and comes into close contact with the end surface (the end surface portion facing the annular groove) on the other side of the rolling ring 3 in the axial line O direction.

In addition, a portion between the interposed ring 5 and the rolling ring 3 is sealed to restrain a liquid from passing through the inner circumference side from the outer circumference of the rolling mill roll 1 by the seal member 9*d*.

Specifically, at least a portion (one location in the present embodiment) between the interposed ring 5 and the rolling ring 3 is sealed to restrain a liquid (cooling water) from passing through the inside of the rolling mill roll 1 from the outside thereof by the seal member 9*d*.

In addition, a plurality of seal members 9*d* may be provided at intervals therebetween or to be adjacent to each other in the radial direction.

The seal member 9*e* (9) is provided on the end surface on the one side of the rolling ring 3 in the axial line O direction. In addition, in other words, the seal member 9*e* (9) is provided on the end surface on the other side of the spacer 8 in the axial line O direction.

That is, the seal member 9*e* is accommodated in an annular groove which is formed in any one of the end surface on the one side of the rolling ring 3 in the axial line O direction and the end surface of the other side of the spacer 8 adjacent to the one side of the rolling ring 3 in the axial line O direction.

In this case, the seal member 9*e* is accommodated in the annular groove to come into close contact with three inner walls (that is, a pair of side walls facing each other in the radial direction and a bottom wall extending in the radial direction) of the annular groove and slightly protrudes from an opening portion of the annular groove toward the outside of the annular groove. In addition, the portion of the seal member 9*e* protruding toward the outside of the annular groove comes into close contact with the end surface portion facing the annular groove.

In the shown example, the seal member 9*e* is accommodated in the annular groove formed on the end surface on the other side of the spacer 8 in the axial line O direction. In addition, a portion of the seal member 9*e* slightly protrudes from the annular groove toward the other side in the axial line O direction (toward the outside of the annular groove) and comes into close contact with the end surface (the end surface portion facing the annular groove) on the one side of the rolling ring 3 in the axial line O direction.

In addition, a portion between the rolling ring 3 and the spacer 8 is sealed to restrain a liquid from passing through the inner circumference side from the outer circumference of the rolling mill roll 1 by the seal member 9*e*.

Specifically, at least a portion (one location in the present embodiment) between the rolling ring 3 and the spacer 8 is sealed to restrain a liquid (cooling water) from passing through the inside of the rolling mill roll 1 from the outside thereof by the seal member 9*e*.

In addition, a plurality of seal members 9*e* may be provided at intervals therebetween or to be adjacent to each other in the radial direction.

The seal member 9*f* (9) is provided on the end surface on the one side of the spacer 8 in the axial line O direction. In addition, in other words, the seal member 9*f* (9) is provided on the end surface on the other side of the rolling ring 3 in the axial line O direction.

That is, the seal member 9*f* is accommodated in an annular groove which is formed in any one of the end surface on the one side of the spacer 8 in the axial line O direction and the end surface of the other side of the rolling ring 3 adjacent to the one side of the spacer 8 in the axial line O direction.

In this case, the seal member 9*f* is accommodated in the annular groove to come into close contact with three inner walls (that is, a pair of side walls facing each other in the radial direction and a bottom wall extending in the radial direction) of the annular groove and slightly protrudes from an opening portion of the annular groove toward the outside of the annular groove. In addition, the portion of the seal member 9*f* protruding toward the outside of the annular groove comes into close contact with the end surface portion facing the annular groove.

In the shown example, the seal member 9*f* is accommodated in the annular groove formed on the end surface on the one side of the spacer 8 in the axial line O direction. In addition, a portion of the seal member 9*f* slightly protrudes from the annular groove toward the one side in the axial line O direction (toward the outside of the annular groove) and comes into close contact with the end surface (the end surface portion facing the annular groove) on the other side of the rolling ring 3 in the axial line O direction.

In addition, a portion between the spacer 8 and the rolling ring 3 is sealed to restrain a liquid from passing through the inner circumference side from the outer circumference of the rolling mill roll 1 by the seal member 9*f*.

Specifically, at least a portion (one location in the present embodiment) between the spacer 8 and the rolling ring 3 is sealed to restrain a liquid (cooling water) from passing through the inside of the rolling mill roll 1 from the outside thereof by the seal member 9*f*.

In addition, a plurality of seal members 9*f* may be provided at intervals therebetween or to be adjacent to each other in the radial direction.

The seal member 9*g* (9) is provided on the end surface on the one side of the rolling ring 3 in the axial line O direction. In addition, in other words, the seal member 9*g* (9) is provided on the end surface on the other side of the support nut 4 in the axial line O direction.

That is, the seal member 9*g* is accommodated in an annular groove which is formed in any one of the end surface on the one side of the rolling ring 3 in the axial line O direction and the end surface of the other side of the support nut 4 adjacent to the one side of the rolling ring 3 in the axial line O direction.

In this case, the seal member 9*g* is accommodated in the annular groove to come into close contact with three inner walls (that is, a pair of side walls facing each other in the radial direction and a bottom wall extending in the radial direction) of the annular groove and slightly protrudes from an opening portion of the annular groove toward the outside of the annular groove. In addition, the portion of the seal member 9*g* protruding toward the outside of the annular groove comes into close contact with the end surface portion facing the annular groove.

In the shown example, the seal member 9*g* is accommodated in the annular groove formed on the end surface on the other side of the support nut 4 in the axial line O direction. In addition, a portion of the seal member 9*g* slightly protrudes from the annular groove toward the other side in the axial line O direction (toward the outside of the annular groove) and comes into close contact with the end surface (the end surface portion facing the annular groove) on the one side of the rolling ring 3 in the axial line O direction.

In addition, a portion between the rolling ring 3 and the support nut 4 is sealed to restrain a liquid from passing through the inner circumference side from the outer circumference of the rolling mill roll 1 by the seal member 9*g*.

Specifically, at least a portion (one location in the present embodiment) between the rolling ring 3 and the support nut 4 is sealed to restrain a liquid (cooling water) from passing through the inside of the rolling mill roll 1 from the outside thereof by the seal member 9*g*.

In addition, a plurality of seal members 9*g* may be provided at intervals therebetween or to be adjacent to each other in the radial direction.

In addition, preferably, the annular groove in which each of the seal members 9*c* to 9*g* is accommodated is formed on a member (a material which has relatively low hardness and secures toughness) formed of a steel material except for the rolling ring 3 rather than the rolling ring 3 formed of cemented carbide.

(Effect of Present Embodiment)

In this rolling mill roll 1 of the present embodiment, by adjusting the screwing positions (screwing amounts) of the screw shafts 7 with respect to the screw holes 12 of the pressing nut 6, the interposed ring 5 is pushed toward one side in the axial line O direction by the screw shafts 7. Accordingly, the rolling rings 3 are pressed toward the one side in the axial line O direction via the interposed ring 5.

Since the movements of the rolling rings 3 toward the one side in the axial line O direction are restrained by the support nut 4, the rolling rings 3 are held from both sides in the axial line O direction by the support nut 4 and the interposed ring 5. Accordingly, the rolling rings 3 are fixed to the shaft member 2.

In addition, the spacer 8 is also fixed to the shaft member 2 by the above-described operation.

Since the present embodiment uses the above-described configuration, for example, a complicated large-scale facility such as using a hydraulic adjustment mechanism for fixing the rolling rings 3 is not required, and it is possible to simplify the facility.

In addition, in the present embodiment, since the screw shafts 7 screwed into the screw holes 12 of the pressing nut 6 press the interposed ring 5, a gap is formed between the pressing nut 6 and the interposed ring 5 according to the screwing amounts of the screw shafts 7. However, in the rolling mill roll 1 of the present embodiment, at least a portion between the pressing nut 6 and the interposed ring 5 adopts the configuration which seals the portion so as to restrain passage of a liquid from the outer circumference of the rolling mill roll 1 to the inner circumference side thereof.

That is, at least a portion between the pressing nut 6 and the interposed ring 5 is sealed. Accordingly, it is possible to restrain a liquid from entering the inside of the rolling mill roll 1 from the outside thereof through a portion between the pressing nut 6 and the interposed ring 5.

Accordingly, it is possible to prevent cooling water supplied during rolling from entering the portions between the rolling rings 3 and the shaft member 2 through the portion between the pressing nut 6 and the interposed ring 5.

In this way, in the rolling mill roll 1 of the present embodiment, since it is possible to prevent entering of the cooling water, it is possible to prevent corrosion of the shaft member 2, and for example, it is possible to effectively prevent slip of the rolling ring 3 or wear of the shaft member 2.

As described above, according to the present embodiment, it is possible to accurately and safely perform rolling over a long period of time and extend the tool life by preventing corrosion of the shaft member 2 generated due to entering of cooling water.

In addition, in the present embodiment, the pressing nut 6 and the interposed ring 5 are positioned to face each other in the radial direction at the predetermined position further outside in the radial direction than portions (portions of the interposed ring on which the screw shafts 7 abut) of the interposed ring 5 which is pressed by the screw shafts 7.

In addition, the seal member 9*c* is disposed at the predetermined position, and the portion between the pressing nut 6 and the interposed ring 5 is sealed by the seal member 9*c* to restrain passage of a liquid.

Accordingly, even in a case where a relative position between the pressing nut 6 and the interposed ring 5 in the axial line O direction is changed (even when the pressing nut 6 and the interposed ring 5 slidably move in the axial line O direction) by adjusting the screwing amounts of the screw shafts 7 with respect to the screw holes 12 of the pressing nut 6 during the fixing of the rolling ring 3, since the relative position in the radial direction between the pressing nut 6 and the interposed ring 5 is not changed at the predetermined position, it is possible to favorably maintain the seal state realized by the seal member 9*c* at the predetermined position.

Therefore, the above-described effects of the present invention are more stably achieved.

In addition, the predetermined position at which the seal member 9*c* is disposed is positioned further outside in the radial direction than the portions of the interposed ring 5 pressed by the screw shafts 7. Accordingly, it is possible to prevent cooling water from entering "the portion where the screw shafts 7 press the interposed ring 5" which tends to require an adjustment space, by the seal member 9*c*. Therefore, it is possible to prevent accumulation of water in the adjustment space.

Accordingly, not only corrosion of the shaft member 2 but also corrosion of the pressing nut 6, the screw shafts 7, and the interposed ring 5 can be prevented.

In addition, in the present embodiment, the case is described in which the seal member 9*c* is provided at the predetermined position at which the pressing nut 6 and the interposed ring 5 face each other in the radial direction and the portion between the pressing nut 6 and the interposed ring 5 is sealed to restrain the liquid from passing through. However, the present invention is not limited to this.

For example, in a case where the portion of the pressing nut 6 and the interposed ring 5 can be sealed to restrain the liquid from passing through the inner circumference side of the rolling mill roll 1 from the outer circumference thereof by the fitting between the fitting hole portion 13 of the pressing nut 6 and the fitting shaft portion 11 of the interposed ring 5, the seal member 9*c* may not be provided.

In addition, in this case, similarly, the seal member 9*a* may not be provided.

In addition, in the present embodiment, the annular seal members 9*d* to 9*g* extending around the axial line O are provided on both end surfaces of the rolling ring 3 in the axial line O direction, the end surface on the one side of the interposed ring 5 in the axial line O direction, both end surfaces of the spacer 8 in the axial line O direction, and the end surface on the other side of the support nut 4 in the axial line O direction. Accordingly, it is possible to prevent cooling water from entering portions between the rolling rings 3, the interposed ring 5, the spacer 8, and the support nut 4, and the shaft member 2 through the end surfaces of the rolling rings 3, the interposed ring 5, the spacer 8, and the support nut 4.

Accordingly, it is possible to more reliably prevent the corrosion of the shaft member 2.

In addition, in a case where the seal members 9*d* to 9*g* are not provided on both end surfaces of each of the rolling rings 3 in the axial line O direction, the end surface on the one side of the interposed ring 5 in the axial line O direction, both end surfaces of the spacer 8 in the axial line O direction, and the end surface on the other side of the support nut 4 in the axial line O direction and it is possible to seal the portions between the end surfaces by only abutment (close-contact) between facing end surfaces so as to restrain a liquid from entering from the outer circumference of the rolling mill roll 1 to the inner periphery side thereof, the seal members 9*d* to 9*g* may not be provided on the end surfaces.

In addition, as described in the present embodiment, the rolling ring 3 and the interposed ring 5 may be disposed to be adjacent (to come direct contact with) to each other in the axial line O direction. However, unlike the present embodiment, the spacer 8 may be disposed between the rolling ring 3 and the interposed ring 5.

In either configuration, it is possible to prevent cooling water from entering the inside of the rolling mill roll 1.

In addition, the screw hole 12 which is open to the end surface on the other side of the pressing nut 6 in the axial line O direction is filled with the seal member 9*b* such as a silicon caulking agent. Accordingly, even when the screw shaft 7 moves in the axial line O direction, it is possible to secure sealability between the screw shafts 7 and the screw holes 12. Therefore, it is possible to prevent cooling water from entering the inside of the rolling mill roll 1 through portions between the screw shafts 7 and the screw holes 12.

In addition, in the present embodiment, the surface-hardening treatment is applied to at least the portions pressed by the screw shafts 7 in the end surface on the other side of the interposed ring 5 in the axial line O direction. Accordingly, it is possible to increase the hardness of the portions of the interposed ring 5 pressed by the screw shafts 7.

Therefore, when the rolling rings 3 are fixed to the shaft member 2 by pressing the rolling rings 3 in the axial line O direction via the interposed ring 5 using the screw shafts 7 screwed into the screw holes 12 of the pressing nut 6, it is possible to prevent the end surfaces of the interposed ring 5 from being deformed (recessed) by the pressing forces of the screw shafts 7.

Therefore, it is possible to reliably fix the rolling rings 3 to the shaft member 2. In addition, even when the end surface of the interposed ring 5 is repeatedly pressed by the screw shafts 7, the above-described effects can be stably achieved.

Moreover, in the case where the hardness of the portion of the end surface of the interposed ring 5 which is pressed by the screw shafts 7 has a Rockwell hardness of 45 HRC or more, it is possible to favorably prevent the end surface of the interposed ring 5 from being deformed.

Moreover, in the present embodiment, as the support portion for restraining the movements of the rolling rings 3 toward the one side in the axial line O direction with respect to the shaft member 2, the support nut 4 which is screwed onto the outer circumferential surface of the shaft member 2 and is disposed on the one side of the rolling ring 3 in the axial line O direction is used.

Accordingly, when the rolling ring 3 is fixed to the shaft member 2, effects capable of preventing deformation of the support portion (support nut 4) can be exerted.

Specifically, when the rolling rings 3 are fixed, if the screw shafts 7 are tightened to the screw holes 12 of the pressing nut 6, for example, a large axial load (lateral pressure) having approximately 500 to 600 tons is applied to the rolling mill roll 1 in the axial line O direction, stress is easily concentrated at the support portion receiving the lateral pressure.

Here, in a case where a flange which is integrally formed with the shaft member and protrudes from the outer circumferential surface of the shaft member is used as the support portion like in the related art, a large lateral pressure is applied to the flange, and a base portion of the flange is likely to be deformed or the like. In a case where the flange is deformed or the like, it is not possible to stably fix the rolling ring to the shaft member.

In the present embodiment, as described above, the support nut 4 which is screwed onto the outer circumferential surface of the shaft member 2 is adopted as the support portion. Accordingly, even in a case where a large lateral pressure is applied to the support nut 4, since it is possible to disperse stress over the entire screwing region between the shaft member 2 and the support nut 4, it is possible to prevent deformation or the like of the support nut 4.

Therefore, it is possible to stably fix the rolling rings 3 and, for example, prevent slip or the like of the rolling rings 3.

In addition, in a case where the length (screwing region) of the support nut 4 in the axial line O direction is 30 mm or more, it is possible to more stably obtain effects of stress dispersion easily.

In addition, since the lateral pressure similar to the lateral pressure applied to the support nut 4 is also applied to (reacts on) the pressing nut 6, preferably, the length (screwing amount) of the pressing nut 6 in the axial line O direction is 30 mm or more.

In addition, in the present embodiment, since the screw holes 12 of the pressing nut 6 are disposed at equal intervals in the circumferential direction, it is possible to evenly press the interposed ring 5 in the circumferential direction by the screw shafts 7 screwed into the screw holes 12. Accordingly, it is possible to more stably perform the fixing of the rolling rings 3 via the interposed ring 5.

In addition, in the case where the position in the radial direction at which each of the screw shafts 7 presses the interposed ring 5 is set to correspond to the center portion (the center portion in which distances from the outer peripheral edge part and the inner circumference edge part of the rolling ring 3 are approximately the same as each other) of the rolling ring 3 in the radial direction, the pressing force in the axial line O direction is stably and easily transmitted to the rolling rings 3. Accordingly, in this case, the rolling rings 3 or the spacer 8 is easily fixed to the shaft member 2.

Moreover, in the case where the position in the radial direction at which each of the screw shafts 7 presses the interposed ring 5 is set to correspond to the inner circumference edge part of the rolling ring 3, for example, even when the rolling ring 3 is ground again from the outer circumference thereof due to the use for a long period of time and the outer diameter of the rolling ring 3 decreases, it is possible to stably press the rolling ring 3 using the screw shafts 7 until the tool life.

[Other Configurations Included in Present Invention]

In addition, the present invention is not limited to the above-described embodiment and various modifications can be applied to the present invention within a scope which does not depart from the gist of the present invention.

For example, in the above-described embodiment, the surface-hardening treatment is applied to the portions pressed by at least the screw shafts 7 in the end surface on the other side of the interposed ring 5 in the axial line O direction. However, the present invention is not limited to this. For example, the material of the interposed ring 5 may use a material having high hardness.

In addition, in the above-described embodiment, as shown in FIG. 1, the end surfaces of the rolling rings 3, the support nut 4, the interposed ring 5, the pressing nut 6, and the spacer 8 in the axial line O direction are set to flat surfaces orthogonal to the axial line O direction. However, the present invention is not limited to this.

In addition, in the above-described embodiment, the support nut 4 is used as the support portion. However, the present invention is not limited to this.

For example, an annular flange which protrudes from the outer circumferential surface of the shaft member 2 toward the inside in the radial direction and extends in the circumferential direction may be used as the support portion. In this case, preferably, the length (flange thickness) of the flange in the axial line O direction is sufficiently secured to the extent that deformation or the like does not occur even when the lateral pressure having approximately 500 to 600 tons is applied to the flange.

In addition, configurations (components) described in the above-described embodiment, the modification example, the descriptions, or the like may be combined within the scope which does not depart from the gist of the present invention, and addition, omission, replacement, and other modifications of the configurations may be applied.

In addition, the present invention is not limited by the above-described embodiment and is limited by only claims.

INDUSTRIAL APPLICABILITY

According to the rolling mill roll of the present invention, it is possible to accurately and stably perform rolling over a long period of time and extend the tool life by preventing corrosion of the shaft member generated due to entering of cooling water. Therefore, the present invention has industrial applicability.

REFERENCE SIGNS LIST

1: rolling mill roll
2: shaft member
3: rolling ring
4: support nut (support portion)
5: interposed ring
6: pressing nut
7: screw shaft
9*c*: seal member
9*d*: seal member
9*e*: seal member
9*f*: seal member
9*g*: seal member
12: screw hole
O: axial line

The invention claimed is:

1. A rolling mill roll, comprising:

a shaft member which rotates around an axial line;

a rolling ring which is fitted to an outer circumferential surface of the shaft member;

a support portion which is provided on the outer circumferential surface of the shaft member and restrains a movement of the rolling ring toward one side in an axial line direction, with respect to the shaft member;

an interposed ring which is fitted to the outer circumferential surface of the shaft member and is provided on the other side of the rolling ring in the axial line direction;

a pressing nut which is screwed onto the outer circumferential surface of the shaft member and is disposed to be adjacent to the other side of the interposed ring in the axial line direction;

a screw hole which is formed to penetrate the pressing nut in the axial line direction; and a screw shaft which is screwed into the screw hole and which is capable of pressing the interposed ring toward the one side in the axial line direction, wherein a fitting hole portion is formed on the pressing nut, and is open toward the one side in the axial line direction, the fitting hole portion has an inner circumference surface positioned further outside in a radial direction than the screw hole, the interposing ring has a fitting shaft portion fitted to the inside of the fitting hole portion, the inner circumference surface of the fitting hole portion and an outer circumferential surface of the fitting shaft portion are disposed to face each other in the radial direction, the screw shaft presses the interposing ring toward the one side in the axial line direction by pressing an end face located the other side of the fitting shaft portion in the axial line direction, at least a portion between the pressing nut and the interposed ring is sealed with a first annular seal member provided between the inner circumference surface of the fitting hole portion and an outer circumferential surface of the fitting shaft portion so as to restrain passage of a liquid from an outer circumference of the rolling mill roll to an inner circumference side of the rolling mill roll.

2. The rolling mill roll according to claim 1, wherein second annular seal members extending around the axial line are provided on both end surfaces of the rolling ring in the axial line direction.

3. The rolling mill roll according to claim 2, wherein a third annular seal member extending around the axial line is provided on an end surface on one side of the interposed ring in the axial line direction.

4. The rolling mill roll according to claim 2, wherein the end face of the fitting shaft portion has a portion quenched with high-frequency.

5. The rolling mill roll according to claim 2, wherein the support portion is a support nut which is screwed onto the outer circumferential surface of the shaft member and is disposed on one side of the rolling ring in the axial line direction.

6. The rolling mill roll according to claim 1, wherein a third annular seal member extending around the axial line is provided on an end surface on one side of the interposed ring in the axial line direction.

7. The rolling mill roll according to claim 6, wherein the end face of the fitting shaft portion has a portion quenched with high-frequency.

8. The rolling mill roll according to claim 6, wherein the support portion is a support nut which is screwed onto the outer circumferential surface of the shaft member and is disposed on one side of the rolling ring in the axial line direction.

9. The rolling mill roll according to claim 1, wherein the end face of the fitting shaft portion has a portion quenched with high-frequency.

10. The rolling mill roll according to claim 9, wherein the support portion is a support nut which is screwed onto the outer circumferential surface of the shaft member and is disposed on one side of the rolling ring in the axial line direction.

11. The rolling mill roll according to claim 1, wherein the support portion is a support nut which is screwed onto the outer circumferential surface of the shaft member and is disposed on one side of the rolling ring in the axial line direction.

* * * * *